United States Patent [19]

Hayes

[11] 4,370,016

[45] Jan. 25, 1983

[54] ELECTRICAL COUPLING DEVICES

[76] Inventor: Derek Hayes, Home Farm Cottage, St. Michael, Bungay, Suffolk NR35 INF, England

[21] Appl. No.: 199,509

[22] PCT Filed: Dec. 18, 1979

[86] PCT No.: PCT/GB79/00213

§ 371 Date: Aug. 20, 1980

§ 102(e) Date: Aug. 15, 1980

[87] PCT Pub. No.: WO80/01339

PCT Pub. Date: Jun. 26, 1980

[30] Foreign Application Priority Data

Dec. 20, 1978 [GB] United Kingdom ..... 49215/78

[51] Int. Cl.[3] ..... H01R 13/58

[52] U.S. Cl. ..... 339/103 M; 339/196 M

[58] Field of Search ..... 339/103, 105, 106, 107, 339/196 R, 196 M

[56] References Cited

U.S. PATENT DOCUMENTS

| | | | |
|---|---|---|---|
| 1,601,255 | 9/1926 | Marra | 339/103 R |
| 2,258,712 | 10/1941 | Miller | 173/322 |
| 2,673,968 | 3/1954 | Smith | 339/105 |
| 2,690,470 | 9/1954 | Moorhead | 339/103 B |
| 3,056,852 | 10/1962 | Sachs | 174/153 |

FOREIGN PATENT DOCUMENTS

| | | | |
|---|---|---|---|
| 623460 | 6/1933 | Fed. Rep. of Germany . | |
| 1765938 | 1/1972 | Fed. Rep. of Germany . | |
| 2320836 | 11/1974 | Fed. Rep. of Germany . | |
| 2645143 | 4/1977 | Fed. Rep. of Germany . | |
| 2259462 | 11/1976 | France . | |
| 445592 | 2/1968 | Switzerland . | |
| 1269421 | 4/1972 | United Kingdom | 339/103 R |
| 1383301 | 2/1975 | United Kingdom . | |

*Primary Examiner*—John McQuade

*Attorney, Agent, or Firm*—Dann, Dorfman, Herrell and Skillman

[57] ABSTRACT

An electrical coupling device, for example a 3-pin plug, of the kind comprising a housing, for example a plug base (2), means, such as conductor-piercing members (20–22), within the housing for effecting electrical connection to one or more conductors (not shown) of an electrical cable (1) which enters the housing in use of the device and a cable grip for clamping the cable relative to the housing. The cable grip comprises a pair of cooperating jaws (8, 9) adapted to receive the cable (1) therebetween and camming means formed in the housing into which the pair of jaws with the cable therebetween can be pressed. In the embodiment illustrated, the camming means is provided by the opposed walls (18, 19) of a recess (7) in the base (2), which walls are arranged to exert pressure on a pair of opposed surfaces (11*a*, 12*a*) of the pair of jaws (8, 9) to force the jaws towards one another to grip the cable when the jaws are pressed into the recess in a direction substantially perpendicular to the path of the cable through the jaws. The base (2) comprises means, for example the end wall (17) of the recess (7), to limit movement of the jaws in the direction of the path of the cable through the jaws when a tensile force is applied to the gripped cable in a direction tending to pull the cable out of the coupling device.

13 Claims, 15 Drawing Figures

ELECTRICAL COUPLING DEVICES

Figure 1:
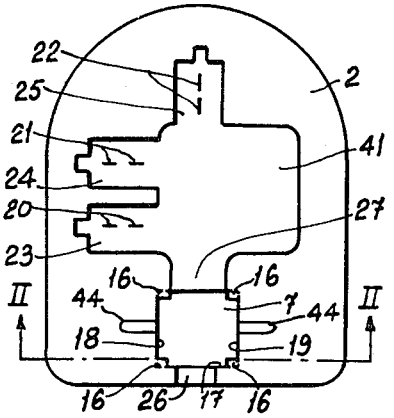

This invention relates to an electrical coupling device, in particular but not exclusively a 3-pin plug, comprising a cable grip.

It is a requirement in many forms of electrical coupling devices, for example multi-pin plugs and pin and socket connectors, that the electrical cable entering the coupling device shall be gripped, independently of the electrical connection(s) to the conductor(s) of the cable, by means of a cable grip. This is to ensure that when a tensile force is applied to the cable, the force is resisted by the cable grip and not transmitted to the electrical connections within the coupling device.

The commonest cable grip used in electrical coupling devices, particularly in multi-pin plugs, has a strip of electrically insulating material which is caused to clamp the electrical cable against a surface of the coupling device by means of two screws which engage screw-threaded holes in the strip. Although capable of accommodating cables in a wide range of different sizes, this kind of cable grip has the serious disadvantage that the screw threads in the strip are very easily sheared by the metallic screws, and when this happens the cable grip is rendered useless. Furthermore, parts of the cable grip are easily lost.

Another known kind of cable grip in electrical coupling devices provides resilient blades of plastics material which flex apart when an electrical cable is placed between them and bite into the electrical insulation of the cable. It is not unknown for this kind of cable grip to strip the insulation from the electrical cable being clamped when an external tensile force is applied to the cable.

The present invention aims to provide an electrical coupling device having a cable grip which does not have the disadvantages mentioned above.

According to the invention, an electrical coupling device of the kind comprising a housing, meams within the housing for effecting electrical connection to one or more conductors of an electrical cable which enters the housing in use of the device and a cable grip for clamping the cable relative to the housing, is characterised in that the cable grip comprises a pair of cooperating jaws adapted to receive the cable therebetween and camming means formed in the housing into which the pair of jaws with the cable therebetween can be pressed, said camming means being arranged to exert pressure on a pair of opposed surfaces of the pair of jaws to force the jaws towards one another to grip the cable when the jaws are pressed into the camming means in a direction substantially perpendicular to the path of the cable through the jaws, and said housing comprising means to limit movement of the jaws in the direction of said path when a tensile force is applied to the gripped cable in a direction tending to pull the cable out of the coupling device.

Said housing may comprise a base, for example of electrically insulating material, and a cover removably mounted on the base. The camming means may then be in the form of a recess in the base and the jaws may be secured to the cover. Alternatively, the camming means may be in the form of a recess in the cover and the jaws may be secured to the base. In either case, the recess may have inlet and outlet apertures which, in use of the coupling device, accommodate the electrical cable in its passage through the recess. In the particular case of a 3-pin, 13 amp plug of the kind shown and described in FIGS. 1 to 4 of German laid-open patent application No. P. 26 45 143.4, now German published patent application No. 2,645,143 which is incorporated herein by reference, (hereinafter referred to as "the aforesaid Specification"), a fourth pair of jaws similar to the jaws 14*a*, 14*b* may be secured to the plug cover 6 in place of the illustrated cable grip 12 and a fourth recess similar to the recess 23 may be provided in the base 2 to receive and press together the jaws of the fourth pair when the cover 6 is assembled on the base 2. In the wiring-up of such a plug, the cable 7 may be placed between the jaws of the fourth pair before the wires 9–11 are engaged in the jaws 14*a*, 14*b*, 15*a*, 15*b* and 16*a*, 16*b*, respectively. Clearly, the cable-locating slots in the confronting surfaces of the fourth pair of jaws would need to be larger than the slots 17–19.

It is, however, presently preferred, especially in the case of a multi-pin coupling device in accordance with the invention, not to secure the jaws of the cable grip to the housing of the coupling device, but instead to form the jaws of the cable grip as a separate unit, in which the two jaws are hinged to one another. Means may be provided to make the jaws captive in the recess. In this case the jaws are arranged so that they can only be withdrawn partially from the recess, to the extent necessary to allow sufficient separation of the jaws to enable the electrical cable to be placed therebetween.

In preferred embodiments of the coupling device in accordance with the invention, at least one cable-locating slot is formed in at least one of the two faces of the pair of jaws that, in use of the coupling device, confront one another. Preferably, both of these confronting surfaces are provided with at least one cable-locating slot and the latter may be shaped so that, when the two jaws are urged together, the pair, or each pair, of opposed slots defines a hole of oval cross-section. Means may be provided for varying the space available in said at least one cable-locating slot, whereby the pair of jaws can grip securely cables in a range of different sizes. For example, packing pieces may be provided which can be inserted between the jaws of the pair of reduce the space available between the jaws for accommodating the electrical cable. Preferably, these packing pieces are connected permanently to the jaws by flexible connecting means enabling the packing pieces to be positioned either in an operative position between the jaws or in a non-operative position either between the jaws or externally thereof. Of course, such packing pieces could also be used with the conductor-locating jaws described in the aforesaid Specification.

Figure 2:
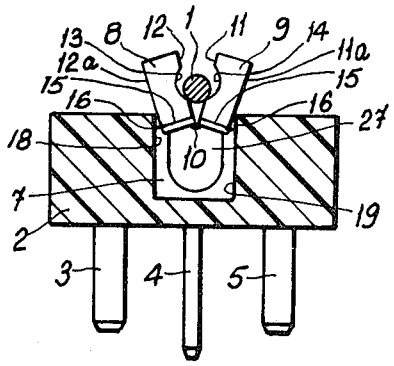
Figure 3:
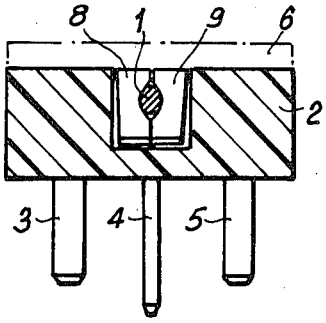
Figure 4:
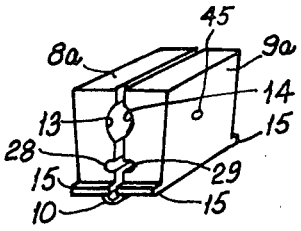
Figure 5:
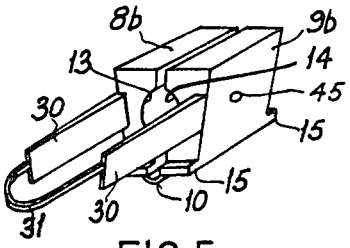
Figure 6:
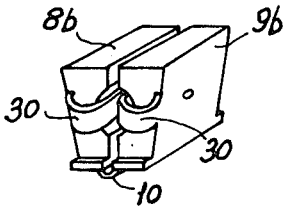
Figure 8:
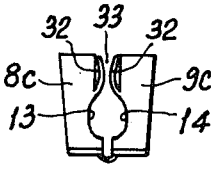
Figure 9:
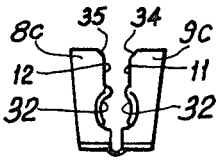
Figure 10:
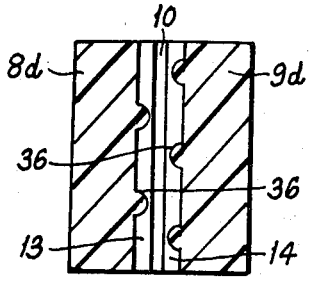
Figure 11:
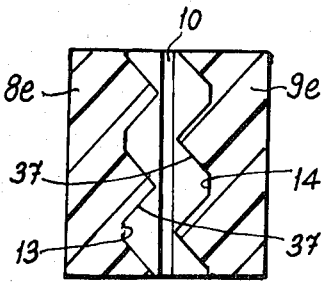
Figure 12:
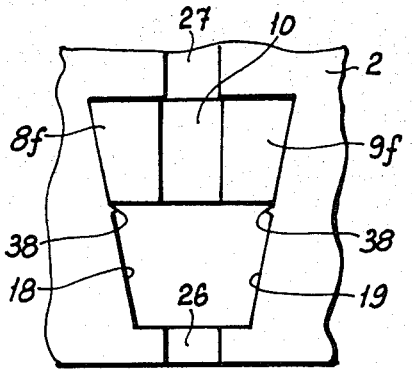
Figure 13:
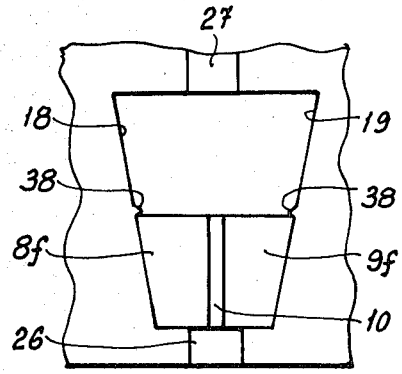
Figure 14:
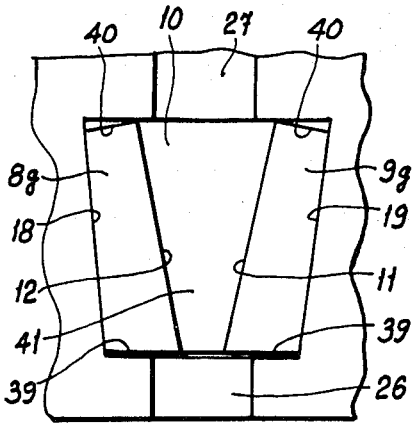
Figure 15:
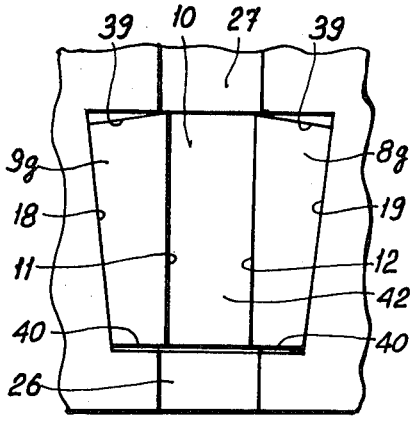

Embodiments of the invention will now be described, by way of example, with reference to the accompanying drawings, in which FIG. 1 is a schematic plan of the base of a 3-pin, 13 amp plug in accordance with the invention, FIG. 2 is a sectional view taken on the line II—II in FIG. 1, a showing the jaws of the cable grip in a partially withdrawn position, FIG. 3 is a view similar to FIG. 2, but showing the jaws of the cable grip fully inserted into the base, FIG. 4 is a perspective view of a first modified embodiment of the jaws of the cable grip of the coupling device of FIG. 1, FIGS. 5 and 6 are perspective views showing two different conditions of a second modified embodiment of the jaws of the cable grip of the coupling device of FIG. 1, FIGS. 7 to 9 are end views showing three different conditions of a third modified embodiment of the jaws of the cable grip of the coupling device of FIG. 1, FIGS. 10 and 11 are sectional plans of fourth and fifth modified embodiments of the jaws of the cable grip of the coupling device of FIG. 1, FIGS. 12 and 13 are schematic plans of part of the base of a modified embodiment of the coupling device of FIG. 1, the two Figures showing different positions of the jaws of the cable grip, and FIGS. 14 and 15 are schematic plans of part of the base of another modified embodiment of the coupling device of FIG. 1, the two Figures showing different positions of the jaws of the cable grip.

The plug base shown in FIGS. 1 to 3 is of generally the same construction as the plug base 2 shown in FIGS. 1 and 3 of the aforesaid Specification, and is also designated by the reference numeral 2. The base 2 is provided with neutral, live and earth pins 3, 4 and 5, respectively, and these may be constructed as shown in FIG. 4 of the aforesaid Specification.

As in the case of the plug shown in FIGS. 1 to 4 of the aforesaid Specification, the plug base 2 has recesses 23, 24 and 25 formed therein in which are located metallic, insulation-piercing means 20, 21 and 22, respectively. The piercing means 20 and 22 are electrically and physically connected to the pins 3 and 5, respectively, and the piercing means 21 is electrically connected to the pin 4 via a fuse (not shown), which may be arranged in the same way as the fuse 30 shown in FIGS. 1 and 4 of the aforesaid Specification.

Electrical connection of the conductors of a 3-core cable to the piercing means 20, 21 and 22 is effected employing three sets of jaws (not shown) of the kind illustrated in, and described with reference to, FIG. 7 of the aforesaid Specification. When the connections have been effected, the open top of the base 2 is closed by a simple cover shown in chain lines, and designated by the numeral 6, in FIG. 3. This cover may be provided with projections to locate it with respect to the recess 41 in the base 2, and any suitable means (not shown), for example a screw, is provided for removably securing the cover to the base 2.

In the base 2 there is a blind recess 7 of rectangular cross-section for the reception of a fourth pair of jaws consisting of jaws 8 and 9 connected together by a hinge 10 (see FIG. 2). These jaws and their hinge are preferably moulded in one piece from a resilient plastics material, for example polyurethane, and the hinge is arranged so that the jaws are naturally sprung apart at their free ends, i.e. into the position shown in FIG. 2. The two jaws taper slightly in the direction towards their hinged ends, as can be seen from FIG. 3. In the confronting faces 11, 12 of the jaws there is a respective cable-locating slot 13, 14 which, when the two jaws are brought together as shown in FIG. 3, define a hole through the jaws of oval shape. Along the lower edge of each of its end faces, each jaw 8, 9 has a flange 15. These flanges cooperate with corner pieces 16 at the upper end of each corner of the recess 7, so as to make it difficult to remove the jaws from the recess 7 during wiring-up of the plug.

During wiring-up of the plug described above, the 3-core cable which is to be connected to the piercing means 20–22, and which is designated with the reference numeral 1 in FIG. 2, is arranged between the jaws 8, 9 with the latter partly withdrawn from the recess 7 (FIG. 2). The two jaws 8, 9 are then pressed into the recess 7, for example by a thumb of the user, with the result that the opposed sides 18, 19 of the recess 7 act as camming means on the faces 12*a*, 11*a* of the jaws to urge the jaws together (FIG. 3). When the jaws 8, 9 have been pressed into the recess 7 in this way, the cable 1 is firmly gripped between the confronting surfaces of the slots 13, 14 and externally of the jaws the cable is accommodated in channels 26, 27 formed in the base 2 and opening into the recess 7. The end face 17 of the recess 7 prevents the jaws from being pulled from the recess 7 if the cable 1 is subjected to a tensile force tending to pull it from the plug.

The cable grip formed by the jaws 8, 9 in the plug described with reference to FIGS. 1 to 3 can securely grip cables having a range of different cross-sectional areas, since the oval shape of the cable-receiving hole through the jaws when the latter are in the position shown in FIG. 3 allows deformation of cables having a diameter in excess of the length of the minor axis of the oval cross-section.

Various modifications may be made to the jaws 8, 9 to enable the cable grip to accommodate and securely grip cables having a greater range of cross-sectional areas than can be securely gripped by the cable grip of FIGS. 1 to 3. In a first modified embodiment, shown in FIG. 4, the jaws 8*a* and 9*a* have an additional cable-locating slot 28, 29, respectively, as well as the cable-locating slot 13 or 14. When the jaws 8*a*, 9*a* are urged together, the slots 28, 29 define a hole through the jaws of much smaller cross-sectional area than the hole defined by the slots 13 and 14. When the plug is being wired-up with power cable (for example of 10 or 13 amps rating) the cable would be gripped in the slots 13, 14, whereas when it is being wired up with smaller cable (for example lighting flex of up to 5 amps rating) the cable would be gripped in the slots 28, 29. If the plug is being wired-up with a very thin cable that cannot even be gripped sufficiently in the slots 28, 29, a satisfactory clamping of the cable may be achieved by passing the cable into the plug through the slots 13, 14, then bending the cable through 180° and passing it back through the slots 28, 29 and finally bending the cable again through 180° and passing it once more through the slots 13, 14 into the interior of the plug.

A second modified set of jaws 8*b*, 9*b* for use in a plug of the kind shown in FIGS. 1 to 3 is shown in FIGS. 5 and 6. FIG. 5 shows that each of the jaws 8*b*, 9*b* has a thin blade 30 projecting from an end face thereof, the thickness of each blade decreasing in the direction towards its free end. At their free ends the two blades are connected by a loop 31. The blades 30 and the loop 31 may all be moulded integrally with the jaws 8*b*, 9*b* for example from polyurethane. The jaws 8*b*, 9*b* can be employed in the plug base 2 of FIGS. 1 to 3 in the condition shown in FIG. 5, the blades 30 and the loop 31 being accommodated in the channel 27 (FIG. 1). The jaws would be used in this way when wiring-up the plug with a cable of large size. Alternatively the jaws 8*b*, 9*b* can be employed in the plug base 2 of FIGS. 1 to 3 in the condition shown in FIG. 6, in which the blades 30 have been drawn into the hole defined by the slots 13, 14. This positioning of the blades is achieved using the loop 31 when the two jaws are in their separated condition (i.e. the position of the jaws 8, 9 shown in FIG. 2). The jaws 8*b*, 9*b* would be used in the condition shown in FIG. 6 when the plug is being wired-up with a cable of small size. Since the blades 30 taper in thickness towards their free ends, it will be appreciated that the further the blades 30 are drawn into the slots 13, 14, the smaller will be the cable-locating space available, the blades thus acting as adjustable packing pieces.

Figure 7:
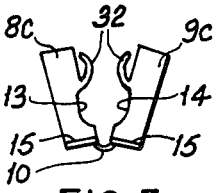

A third modified set of jaws 8*c*, 9*c* for use in a plug of the kind shown in FIGS. 1 to 3 is shown in FIGS. 7 to 9. FIG. 7 shows that each of the jaws 8*c*, 9*c* has a thin blade 32 projecting from that surface thereof which confronts the other jaw. The blades 32 and the jaws 8*c*, 9*c* may be moulded integrally with one another, for example from polyurethane. FIG. 8 shows the jaws 8*c*, 9*c* urged together and with the blades 32 accommodated in the gap 33 between the jaws. The jaws would be used in this condition when required to grip a cable of large size in the hole defined by the slots 13, 14. FIG. 9 shows the jaws 8*c*, 9*c* urged together and with the blades 32 bent down and accommodated in the hole defined by the slots 13, 14. The jaws would be used in this condition when required to grip a cable of small size.

In use of the various pairs of jaws described above, there is a risk that the finger or thumb used to press the jaws into the recess 7 may be nipped between the upper edges of the faces 11, 12 as the jaws are pressed in. This risk can be considerably reduced by chamfering the upper edges of the faces 11, 12, as indicated at 34, 35 in FIG. 9.

In all the embodiments so far described, the cable-locating slots 13, 14 of the jaws are of substantially semicylindrical shape, being either of the same substantially semi-circular, or the same substantially semi-elliptical, cross-section throughout their length. FIGS. 10 and 11 show two further pairs of jaws 8*d*, 9*d* and 8*e*, 9*e* in which the slots 13, 14 are provided with semi-spherical projections 36 (FIG. 10) or a series of spaced-apart, substantially vertical ridges 37 (FIG. 11) so as to force the cable which is to be gripped to follow a tortuous path.

In the embodiments described above, it has been assumed that the jaws 8, 9, 8*a*, 9*a*, etc. are inserted into a rectangular recess 7 in the base 2 of the plug. In another embodiment of the invention, shown in FIGS. 12 and 13, the recess 7 in the base 2 has sides 18, 19 which are inclined to one another, these sides being closer together adjacent to the channel 26 than adjacent to the channel 27. In this embodiment, each of the jaws 8*f*, 9*f* of the pair of jaws inserted into the recess 7 is shorter than the recess, so that the jaws can be inserted into the recess in one of the two alternative positions shown in FIGS. 12 and 13, namely a first position adjacent to the channel 27 (FIG. 12) or a second position adjacent to the channel 26 (FIG. 13). The first position would be used when it was desired to grip a thick cable (for example a power cable) and the second position would be used when it was desired to grip a thin cable (for example lighting flex). In this embodiment, the hinge 10 of the pair of jaws would be dimensioned to accommodate the greater spacing apart of the jaws required to receive the cable in the first position. In order to prevent movement of the jaws, in the direction of the gripped cable, means may be provided in the recess 7 and/or on the jaws for positively locating the jaws, relative to the base 2, against movement towards the channel 26 or 27. For example, shoulders 38 may be provided on the sides 18, 19 or on the bottom of the recess 7.

In the embodiment of FIGS. 12 and 13 the pair of jaws 8*f*, 9*f* is intended to take up tow positions in the recess 7. If desired, the jaws may be arranged to take up one of a larger number of positions in the recess 7, positive location of the jaws in the recess being obtained, for example, by the engagement of substantially vertical ribs (not shown), projecting from the outwardly-facing surfaces of the jaws, in substantially vertical grooves (not shown) in the sides 18, 19 of the recess.

FIGS. 14 and 15 show another embodiment of the invention in which the recess 7 in the base 2 has sides 18, 19 which are inclined to one another as in the case of FIGS. 12 and 13. In this embodiment, each jaw 8*g*, 9*g* of the pair of jaws inserted into the recess 7 is slightly wider at its end 39 compared with its end 40, and a wider hinge 10 is provided between the two jaws than in the embodiments described with reference to FIGS. 1 to 9. The two jaws have substantially the same length as the recess 7.

The pair of jaws 8*g*, 9*g* may be inserted into the recess 7 with the jaw ends 39 adjacent to the channel 26, as shown in FIG. 14, in which case a gap 41 which narrows towards the channel 26 is available between the confronting faces 11, 12 of the jaws, suitable for gripping a thin cable. Alternatively, the pair of jaws may be inserted into the recess 7 with the jaw ends 40 adjacent to the channel 26, as shown in FIG. 15, in which case a gap 42 which is wider than the narrowest portion of the gap 41 is available between the confronting faces 11, 12 of the jaws, suitable for gripping a thicker cable. The confronting surfaces 11, 12 may be provided with cable-locating slots 13, 14, as in the previously described embodiments. If desired, the sides 18, 19 of the recess 7 may be inclined to one another in the opposite direction to that shown, so that the sides are closer together adjacent to the channel 27 than adjacent to the channel 26.

In each of the embodiments of the plug described above with reference to the drawings, the pair of jaws 8, 9, 8*a*, 9*a*, etc. securely grips the cable 1 along an appreciable length of the cable, and tensile forces acting on the cable 1 and tending to pull it out of the plug are resisted by the material of the base 2 on each side of the channel 26 as well as by the friction between the jaws and the sides 18, 19 of the recess 7. Owing to the relatively large surface area of the cable 1 that is gripped by the jaws of the cable grip, there is virtually no possibility of these jaws stripping the insulation from the cable when a tensile force is exerted thereon tending to pull the cable from the plug. Since there are no screws associated with the jaws of the cable grip, there is no possibility of the cable grip being rendered useless by the stripping of screwthreads, and since the jaws are captive in the recess 7 there is no danger of parts of the cable grip being lost. Furthermore, in the case of the embodiments of the plug described above with reference to the drawings, the entire wiring-up of the plug can be effected without the need to use a screw-driver. The only tool required is a knife or other cutting implement for removing the outer sheath from the cable 1 and cutting the insulated conductors to the lengths necessary to bring them into the recesses 23–25.

When it is desired to disconnect the cable from the plug shown in FIGS. 1 to 3, the jaws 8, 9 have to be partially withdrawn from the recess 7 to the position shown in FIG. 2. To facilitate this operation, slots 44 may be formed in the sides 18, 19 of the recess 7 (see FIG. 1) and dimples 45 may be formed in the outwardly-facing side surfaces of the jaws (see FIGS. 4 and 5). It is then a simple matter to lever the jaws upwardly in the recess 7 using a suitable implement, for example a knitting needle, engaging the dimples 45 through the slots 44.

The invention is not limited to electrical coupling devices comprising the particular embodiments of cable grips described above with reference to the drawing. Thus, the jaws 8, 9, 8*a*, 9*a*, etc. need not be uniformly tapered from end to end as shown in the drawing, but may have their outwardly-facing side surfaces shaped in the same way as the jaws shown in FIG. 7 of the aforesaid Specification. Means other than the flanges 15 and the corner pieces 16 may be provided for retaining the jaws in the recess 7. For example, a flexible cord may be secured to, or moulded integrally with the lower end (as viewed in FIG. 2) of one of the jaws and this cord may be anchored in a hole in the base 2 at the bottom of the recess 7, the cord having such a length that it prevents complete withdrawal of the jaws from the recess.

Again, the recess 7 need not be a blind recess but may extend to the underside of the base 2. This makes it possible to have a deeper recess, which facilitates the gripping of a larger range of sizes of cables. Again, a recess which passes right through the base 2 facilitates removal of the jaws from the recess when it is desired to release a gripped cable, since the jaws can be pushed upwardly from the underside of the base. Complete withdrawal of the jaws from the recess may again be prevented by means of a flexible cord or tape, moulded integrally with the lower end of one of the jaws or the hinge of the jaws, the free end of this cord or tape being anchored in a recess formed in a side wall or end of the recess 7 adjacent to the underside of the base 2. Alternatively, a flexible cord may have both its end anchored in recesses formed in opposite end walls of the recess 7 adjacent to the underside of the base 2, this cord passing between the two jaws above the hinge 10. This cord would again have such a length that it prevents complete withdrawal of the jaws from the recess 7.

In the embodiments of the coupling device described above with reference to the drawings, the recess 7 for reception of the pair of cable-gripping jaws is spaced from the recesses 23–25 (see FIG. 1) for the reception of wire-locating jaws. This, of course, need not be the case and in certain types of coupling devices it is possible to combine a wire-locating recess with the recess 7 and to use a single pair of jaws which at one end serves as a cable gripping device and at its other end as a wire-locating device. In this case part of the hinge of the pair of jaws would be provided with holes therethrough for the passage of the insulation-piercing means 20.

Although the invention has been described in detail above with reference to a 3-pin, 13 amp plug, it will be understood that the invention is applicable to other multi-pin and single pin plugs and to other forms of electrical coupling devices.

I claim:

1. In an electrical coupling device comprising a housing, means within the housing for effecting electrical connection to one or more conductors of an electrical cable which enters the housing in use of the device and a cable grip for clamping the cable relative to the housing, the improvement according to which the cable grip comprises a pair of cooperating jaws adapted to receive the cable therebetween and camming means having a pair of opposed walls forming a receptacle of substantially rectangular cross section in the housing into which receptacle the pair of jaws with the cable therebetween can be pressed, said receptacle providing a longitudinal path for the cable between said jaws, said opposed walls being arranged to exert pressure on a pair of opposed surfaces of the pair of jaws to force the jaws towards one another with sufficient force to grip the cable and anchor it against longitudinal displacement in the jaws when the jaws are pressed into the receptacle by pressure in a direction substantially perpendicular to the path of the cable through the jaws and to retain said jaws within the receptacle upon release of said pressure, and said housing comprising means to limit movement of the jaws in the direction of said path when a tensile force is applied longitudinally to the gripped cable in a direction tending to pull the cable out of the coupling device.

2. An electrical coupling device according to claim 1, wherein said housing comprises a base and a cover removably mounted on the base.

3. An electrical coupling device according to claim 2, wherein said camming means is in the form of a recess in said base.

4. An electrical coupling device according to claim 1, comprising at least one cable-locating slot formed in at least one of two faces of the pair of jaws that, in use of the device, confront one another.

5. An electrical coupling device according to claim 4, comprising means to vary the space available in said at least one cable-locating slot for the reception of the electrical cable.

6. An electrical coupling device according to claim 4, wherein said at least one cable-locating slot is provided with projections which, in use of the device, force the electrical cable to follow a tortuous path between the pair of jaws.

7. An electrical coupling device according to claim 1, comprising at least one metallic contact pin secured to and projecting externally of the housing, and means within the housing connecting the pin to said means for effecting electrical connection to a conductor of the electrical cable.

8. An electrical coupling device comprising a housing, means within the housing for effecting electrical connection to one or more conductors of an electrical cable which enters the housing in use of the device, and a cable grip for clamping the cable relative to the housing, the improvement wherein the cable grip comprises a pair of cooperating jaws separate from the housing and adapted to receive the cable in a longitudinal path therebetween, and camming means formed in the housing into which the pair of jaws with the cable therebetween can be pressed, said camming means being arranged to exert sufficient pressure on a pair of opposed surfaces of the pair of jaws to force the jaws towards one another to grip the cable and anchor it against longitudinal displacement in the jaws when the jaws are pressed into the camming means in a direction substantially perpendicular to said path of the cable, the jaws of the pair being hinged together, and said housing comprising means to limit movement of the jaws in the direction of said path when a longitudinal tensile force is applied to the gripped cable in a direction tending to pull the cable out of the coupling device.

9. An electrical coupling device according to claim 8 further comprising means to make the pair of jaws captive in the camming means, so that the jaws can only be withdrawn partially from the camming means to the extent necessary to allow sufficient separation of the jaws to enable the electrical cable to be placed therebetween.

10. An electrical coupling device according to claim 9, wherein said camming means is a blind recess and said means to make the pair of jaws captive in the camming means comprises means connecting the hinged end of the pair of jaws to the bottom of the recess.

11. An electrical coupling device according to claim 8, wherein said camming means comprises a recess in the housing having a pair of opposed walls which converge towards one another in the direction of said path.

12. An electrical coupling device according to claim 11, wherein said camming means has a greater length, in the direction of said path, compared with said jaws, and means is provided enabling reception of the pair of jaws in a plurality of different positions in the camming means lengthwise of the latter.

13. An electrical coupling device according to claim 11, wherein each jaw of the pair of jaws has a width, perpendicular to the direction of said path, which decreases in the direction of said path.

* * * * *